US006968583B1

(12) United States Patent
Rich

(10) Patent No.: US 6,968,583 B1
(45) Date of Patent: Nov. 29, 2005

(54) ADJUSTABLE BED RISER

(75) Inventor: Ronald Rich, Burton, OH (US)

(73) Assignee: Waxman Consumer Products Group, Inc., Bedford Heights, OH (US)

( * ) Notice: Subject to any disclaimer, the term of this patent is extended or adjusted under 35 U.S.C. 154(b) by 0 days.

(21) Appl. No.: 10/966,902

(22) Filed: Oct. 15, 2004

(51) Int. Cl.[7] ..... A47C 21/00; A47C 31/00; F16M 11/24

(52) U.S. Cl. ..... 5/509.1; 248/188.2

(58) Field of Search ..... 5/509.1, 658, 11; 248/188.2

(56) References Cited

U.S. PATENT DOCUMENTS

| | | | |
|---|---|---|---|
| 1,402,998 | A | 1/1922 | Anderson |
| 2,072,791 | A | 3/1937 | Baer |
| 2,750,709 | A | 6/1956 | Saverino |
| 2,933,850 | A | 4/1960 | Martin |
| 3,795,925 | A | 3/1974 | Leagus, Jr. |
| 5,037,084 | A | 8/1991 | Flor |
| 5,118,095 | A | 6/1992 | Flor |
| D338,360 | S | 8/1993 | Petersen |
| 5,345,631 | A | 9/1994 | Saperstein et al. |
| 5,591,105 | A | 1/1997 | Dalebout et al. |
| 5,599,258 | A | 2/1997 | Stone et al. |
| D385,317 | S | 10/1997 | Henriksen |
| D404,992 | S | 2/1999 | Sittig |
| 6,012,185 | A | 1/2000 | Woods et al. |
| 6,345,631 | B1 | 2/2002 | Brunson |
| 6,575,414 | B2 | 6/2003 | Cuzzocrea |

*Primary Examiner*—Alexander Grosz
(74) *Attorney, Agent, or Firm*—Watts Hoffmann Co. LPA

(57) ABSTRACT

A bed riser assembly for providing a plurality of elevations for a bed frame leg is disclosed. The assembly includes a hollow base and a support piece insertable therethrough. The base has an outer longitudinal surface, a first end portion having a first edge surface, a second end portion having a second edge surface, and at least one set of apertures. Each aperture extends through the outer longitudinal surface. The support piece has a side surface, a top end portion defining a top cavity, and a bottom end portion defining a bottom cavity. A set of forks protrudes from the support piece side surface generally toward the bottom end portion. Each of the set of forks is removably insertable into one of the apertures, such that the base and the support piece are coaxially aligned. A user may manipulate the assembly to provide up to seven different elevations.

28 Claims, 3 Drawing Sheets

ADJUSTABLE BED RISER

FIELD OF THE INVENTION

The present invention relates to an adjustable bed riser, and more particularly, to an adjustable bed riser assembly for raising either one or both ends of a bed to a plurality of selectable elevations.

BACKGROUND OF THE INVENTION

Most beds conventionally include a mattress, or a mattress and box spring combination, resting upon a bed frame having four legs. In a normal position, the mattress and frame provide a horizontal platform for enjoyment by a user.

Bed risers may be used to raise the elevation of either one or both ends of a bed frame. It may be necessary to incline the head of the bed for medical reasons, such as to improve the breathing of a person sleeping in the bed. In addition, all four legs of a bed may be raised for certain functional reasons, such as to increase under bed storage, to raise the bedding above floor level, or merely for aesthetic reasons.

A variety of bed risers are known in the art. The most rudimentary risers are simply solid blocks of wood or blocks of wood with a drilled cavity in one face. Although risers of this type provide elevation, these designs do not offer adjustable features. Certain commercially available risers may include two or more stackable blocks or pieces that can be used alone or nested to raise the height of a bed frame leg. Some designs require a large number of blocks to reach substantial heights, e.g., in excess of 4 inches. Still other designs are susceptible to failure or disengagement under significant weight due to insufficient locking structure.

Therefore, what is needed in the art is an adjustable bed riser assembly that has a minimum number of parts, provides a large number of different elevations and is not susceptible to failure or disengagement.

SUMMARY OF THE INVENTION

In an illustrated embodiment of the invention, a bed riser assembly for providing a plurality of selectable elevations for a bed frame leg is disclosed. The assembly includes a hollow base and a support piece that is insertable therein. A user may select up to seven height elevations for a bed frame leg.

The hollow base has an outer longitudinal surface, a first end portion having a first edge surface, a second end portion having a second edge surface, and at least one set of apertures, wherein each aperture extends through the outer longitudinal surface. The support piece is insertable within the base and has a side surface, a top end portion defining a top cavity, and a bottom end portion defining a bottom cavity. A set of forks protrudes from the support piece side surface generally toward the bottom end portion. Each of the set of forks is removably insertable into one of the at least one set of apertures, such that the base and the support piece are coaxially aligned.

In one embodiment, the hollow riser may be tube shaped and consequently, the outer longitudinal surface is cylindrical shaped.

Each of the set of forks may be removably insertable into one of the at least one set of apertures in either a direction generally toward the first end portion or toward the second end portion. Each of the set of forks may be removably insertable into one of the at least one set of apertures in either of two opposing directions.

The top cavity may be adequately sized to allow insertion of an end of a bed frame leg therein. Likewise, the bottom cavity may be adequately sized to allow insertion of an end of a bed frame leg therein.

The base first end portion may include a tapered annular rim, wherein the rim is removable insertable between each of the set of forks and the side support side surface. The support piece may be insertable within the base through either the first end portion or the second end portion.

Each of the least one set of apertures may include at least two apertures, wherein each of the at least two apertures is equidistant from the first edge surface. Each of the at least one set of apertures may include at least two apertures, wherein each of the at least two apertures is essentially identical is size and shape.

Each of the at least one set of apertures may include three apertures, wherein each aperture is essentially identical is size and shape, and is equidistant from the first edge surface. The base may balance upon a horizontal surface by either the first edge surface or by the second edge surface.

Each of the set of forks may be equidistantly disposed about a circumference of the support piece side surface. Each of the at least one set of apertures may be equidistantly disposed about a circumference of the base outer longitudinal surface.

Further features and advantages of the invention will become apparent from the following detailed description made with reference to the accompanying drawings.

DETAILED DESCRIPTION OF THE INVENTION

Figure 1:
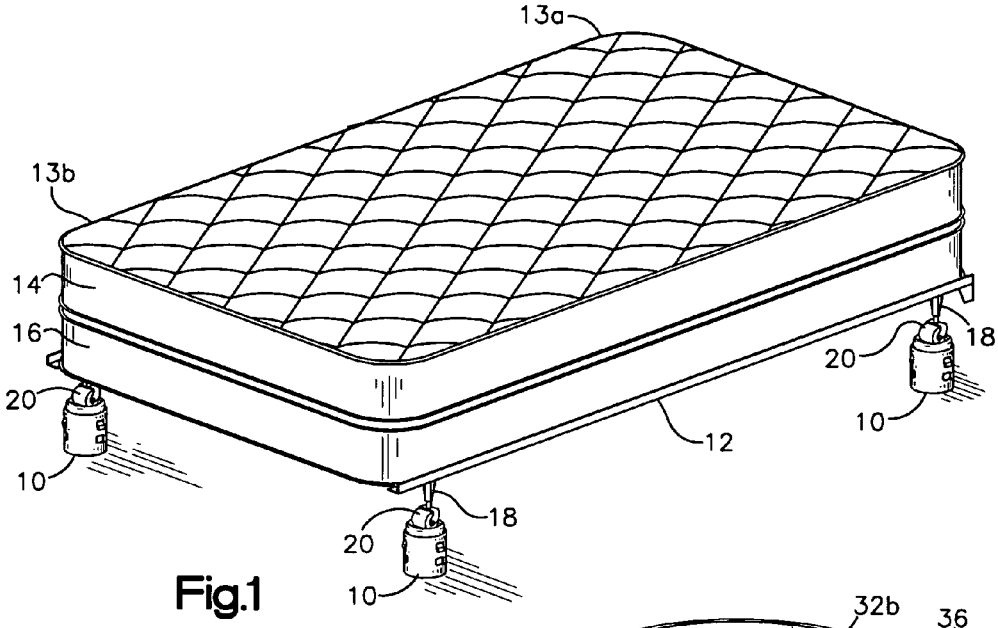
FIG. 1 is a perspective view of three bed riser assemblies shown installed under a bed frame, each assembly constructed in accordance with one embodiment of the present invention.

Referring now to the drawings, a bed riser assembly 10 constructed in accordance with one embodiment of the present invention is illustrated. The bed riser 10 is used to provide adjustable elevation to one or more ends of a bed. It should be understood that the present invention will be described in connection with a metal bed frame having four legs with wheels at the end of each leg. This description is for exemplary purposes only, and the present invention may be practiced in connection with any bed type, including metal frames without wheels and fixed furniture beds.

The present invention allows a user to raise a bed leg to one of up to seven different elevations. The bed riser is adjustable with minimal operation of only two parts, does not require any auxiliary tooling, and maintains structural integrity under anticipated operational conditions.

Referring now to FIG. 1, three bed riser assemblies 10 are shown installed under a bed frame 12 (a fourth assembly is not shown). The bed frame 12 is illustrated with the head 13*a* and foot 13*b* of the bed in the same elevated position. Alternatively, only two assemblies may be used to elevate just one end of the bed. Further, the head 13*a* and foot 13*b* of the bed frame may each be elevated, but to different heights.

The frame 12 supports a conventional mattress 14 and box spring 16 combination. The bed frame as shown is a conventional two-rail metal frame connected by perpendicular supports. The frame 12 has four legs 18. A rotatable wheel 20 is mounted to the end of each leg. When the bed frame 12 is not elevated, the bed may be moved across a horizontal surface by rotation of the wheels.

Figure 2:
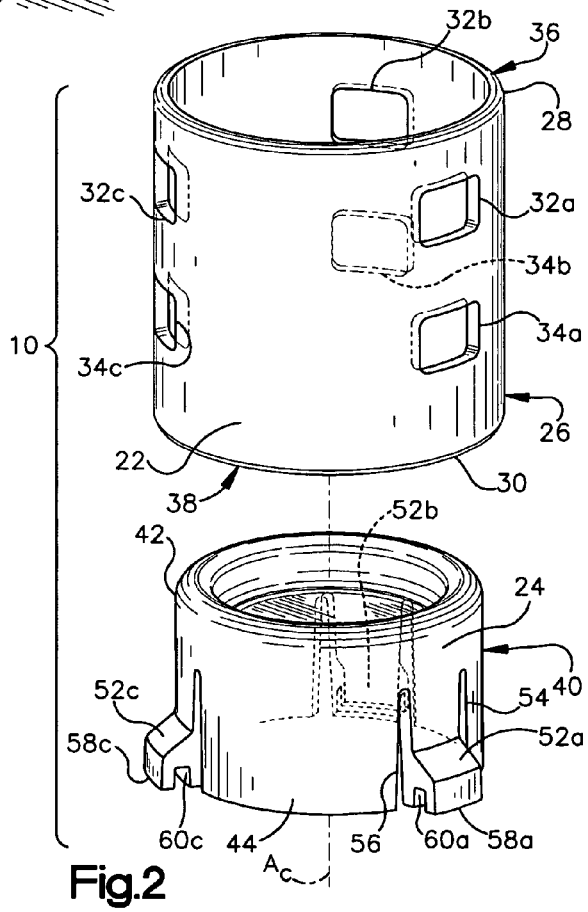
FIG. 2 is an exploded assembly view of the bed riser assembly of FIG. 1, showing a hollow base and a support piece.

An exploded assembly view of the bed riser 10 is shown in FIG. 2. The two-piece bed riser includes a hollow base 22 and a support piece 24. The two pieces are designed to be assembled by a user to provide a plurality of selectable elevations for a bed frame leg. The support piece 24 may be used be itself to provide two elevations, while the base 22 and support piece 24 may be used in combination to produce five additional elevations. In combination, the base 22 and support piece 24 are concentrically aligned about a common center axis $A_c$.

As mentioned, the hollow base 22 is used in combination with the support piece 24 to provide five elevations. In the embodiment illustrated, the base 22 is a cylindrical-shaped tube having an outer longitudinal surface 26, a first end portion 28, and a second end portion 30. The first end portion 28 includes an annular first edge surface 36. When placed upon a horizontal surface, such as a bedroom floor, the base 22 will balance at rest upon the first edge surface 36 without tipping or rocking. The base itself may be constructed of a material that is resistance to slipping so that the first edge surface 36 maintains contact with the horizontal surface upon which it rests. Similarly, the second end portion 30 includes an annular second edge surface 38 upon which the base 22 balances upon when placed on a horizontal surface.

Referring again to FIG. 2, the base 22 includes two sets of apertures, a first set 32*a*, 32*b*, 32*c* and a second set 34*a*, 34*b*, 34*c*. As shown, each set has three apertures. It should be understood by others with ordinary skill in the art, that various numbers of sets, and various numbers of apertures per set, may be utilized in the practice of the present invention.

Each aperture 32*a*, 32*b*, 32*c*, 34*a*, 34*b*, 34*c* extends through the outer longitudinal surface 26 of the base 22. As shown, the apertures 32*a*, 32*b*, 32*c*, 34*a*, 34*b*, 34*c* are identical in shape and size. The apertures are essentially rectangular shaped with curved corners. Although any particular shape and size is not required, the apertures must be shaped to cooperatively join with portions of the support piece 24, to be discussed further in greater detail. Further, to allow a rigid mating connection with the support piece 24, each aperture 32*a*, 32*b*, 32*c* of the first set is equidistantly disposed from the first edge surface 36 and also equidistantly disposed from the second edge surface 38. Likewise, the each aperture 34*a*, 34*b*, 34*c* of the second set is also equidistantly disposed from the first edge surface 36 and from the second edge surface 38. As shown, the first set of apertures 32*a*, 32*b*, 32*c* is disposed a distance from the first edge surface 36 that is shorter than the distance the second set 34*a*, 34*b*, 34*c* of apertures are disposed from the second edge surface 38. To be discussed in more detail, the offset placement of the two aperture sets allows for a larger variety of elevations to be achieved by a user of the bed riser assembly 10. Still in regard to the apertures, the apertures within the first set and within the second set are equidistantly disposed about the circumference of the base 22 outer longitudinal surface 26. As shown, the apertures within each set are disposed approximately 120° apart.

Figure 6:
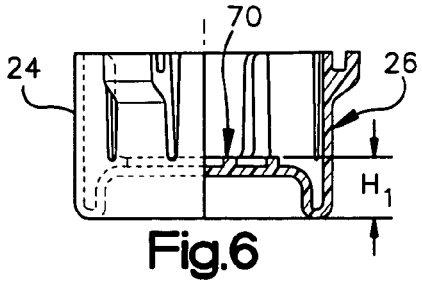
FIG. 6 is a side view, partially in section, of the support piece of FIG. 2 in an inverted position, disclosing a first elevation.
Figure 7:
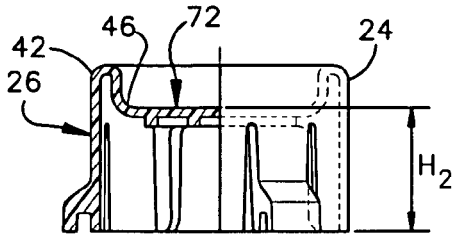
FIG. 7 is a side view, partially in section, of the support piece of FIG. 2 in an upright position, disclosing a second elevation.

As discussed, the bed riser 10 includes a support piece 22. The support piece is the part of the bed riser 10 that contacts the end or wheel 20 of the bed frame leg 18. The support piece may be used by itself to support a bed frame leg, as shown in FIGS. 6 and 7. Alternatively, the support piece may be assembled with the base 22 to support a bed frame leg, as shown in FIGS. 8–12.

Figure 4:
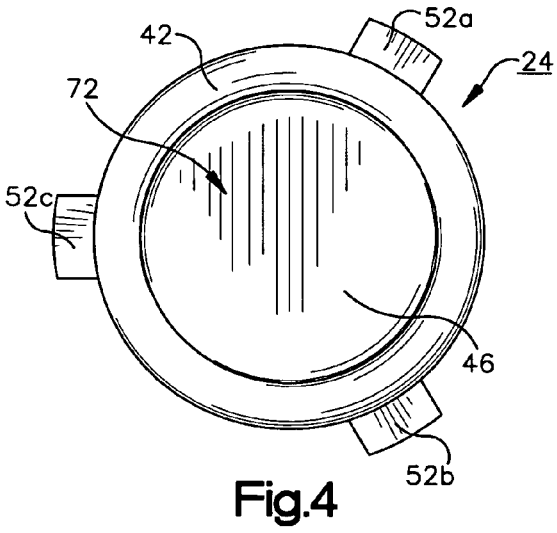
FIG. 4 is a top view of the support piece of FIG. 2.
Figure 5:
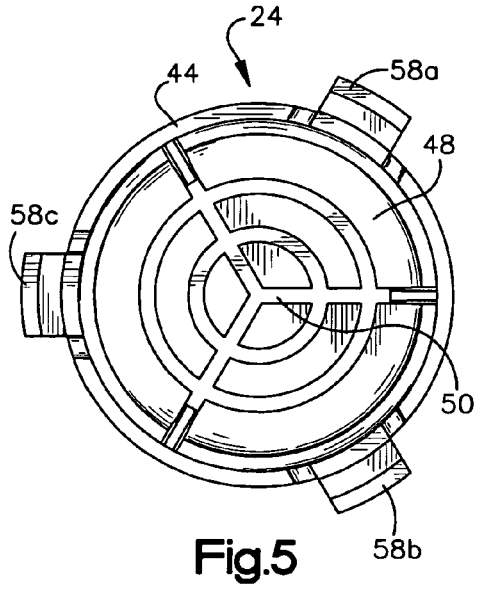
FIG. 5 is a bottom view of the support piece of FIG. 2.

The support piece 24 is a unitary molded piece and has a generally cylindrical-shaped side surface 40, a top end portion 42 and a bottom end portion 44. FIGS. 4 and 5 are top and bottom views of the support piece 24. As best seen in FIGS. 4 and 7, the top end portion 42 defines a top cavity 46. The top cavity 46 is adequately sized and shaped to house a bed frame leg wheel 18 as illustrated in FIG. 1. Further, the bottom end portion 44 defines a bottom cavity 48. The bottom cavity 48 is also adequately sized and shaped to house a bed frame leg. In the embodiment shown, the bottom cavity includes a pattern of raised ribs 50 which act to stabilize a leg inserted into the cavity 48.

The side piece 24 includes a single set of three forks 52*a*, 52*b*, 52*c* protruding from the support piece 24 side surface 40. The forks extend generally toward the support piece 24 bottom end portion 44. The forks are equally spaced about the side surface 40 approximately 120° apart. Any spacing is permissible in the practice of the present invention, although the forks must be cooperatively spaced with the apertures of the base 22.

Figure 3:
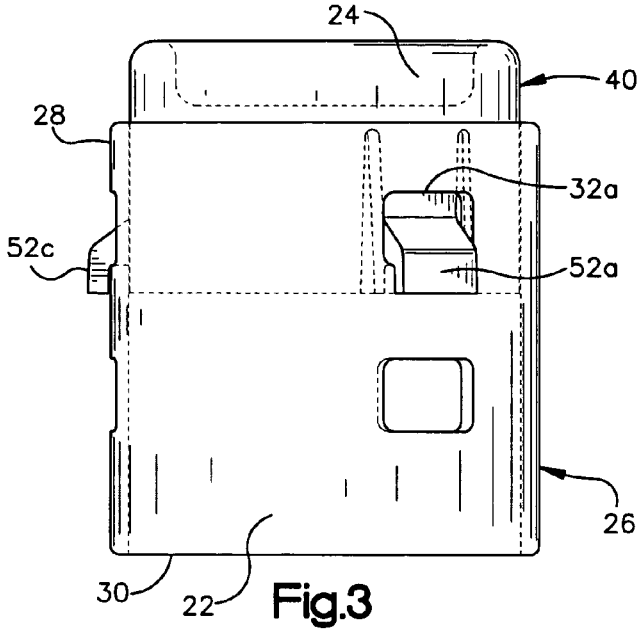
FIG. 3 is a side view of the hollow base and support piece of FIG. 2, shown in one of a plurality of assembled positions.

FIG. 3 is a side view of the hollow base 22 and a support piece 24 of FIG. 2, showing an assembled position as a result of this cooperative spacing. As shown, the set of forks 52*a*, 52*b*, 52*c* is removably insertable into the first set of apertures 32*a*, 32*b*, 32*c* in a direction generally toward the bottom end portion 44 (not shown), i.e., toward the second end portion 30. To create this assembly, the support piece 24 is pressed into the base 22 through the second end portion 30 toward the first end portion 28, or bottom to top as shown in FIG. 3. The forks 52*a*, 52*b*, 52*c* bend inward until reaching the desired set of apertures. Alternatively, the support piece 24 may be inserted from an opposing direction such that the set of forks extends toward the first end portion 28. Referring again to FIG. 3, the base 22 and support piece 24 are concentrically aligned in this assembled position and are sufficiently stable to not tip when supporting a bed frame leg.

One fork 52*a* will be discussed in further detail for purpose of example. The fork 52*a* is defined by two generally parallel slits 54, 56 in the support piece 24 side surface 40. The slits 54, 56 allow the fork 52*a* to bend inward toward the center axis Ac when the support piece 24 is pressed within the base 22. The fork 52*a* includes a small rectangular-shaped tongue 58*a* extending downward from the distal end of the fork. The tongue 58*a* forms the outer side of a notch 60*a*. The notch is adequately sized and shaped such that a portion of the base 22 sidewall that defines a portion of an aperture fits therein, as shown best in FIG. 3. Sectional views of this fit are shown in FIGS. 8–11. As shown in FIG. 12, the notches 60*a*, 60*b*, 60*c* are sized to fit on the base 22 first end portion 28 first edge surface 36.

The illustrated embodiment allows a user to manipulate the support piece 24 and base 22 to created seven different elevations. The first two and shortest elevations are shown in FIGS. 6–7. FIG. 6 is a side view, partially in section, of the support piece 24 of FIG. 2 in an inverted position, showing a first elevation $H_1$. In this position, the bed frame leg rests upon a top surface 70 of the bottom cavity 48. FIG. 7 is a side view, partially in section, of the support piece of FIG. 2 in an upright position, showing a second elevation $H_2$. In this position, the bed frame leg rests upon a top surface 72 of the top cavity 46. As shown, $H_2$ is higher than $H_1$.

Figure 8:
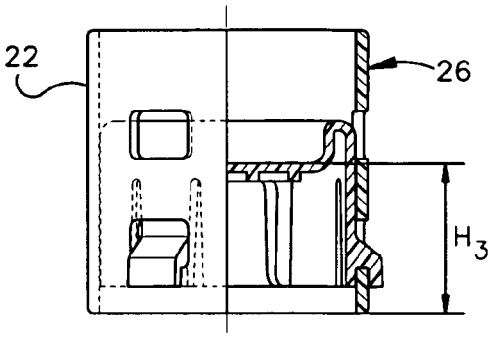
FIG. 8 is a side view, partially in section, of the bed riser of FIG. 1 in a first assembled position, disclosing a third elevation.
Figure 9:
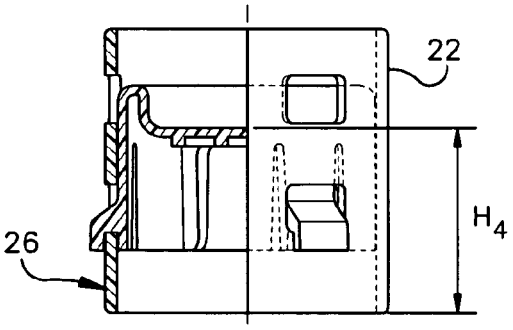
FIG. 9 is a side view, partially in section, of the bed riser of FIG. 1 in a second assembled position, disclosing a fourth elevation.
Figure 10:
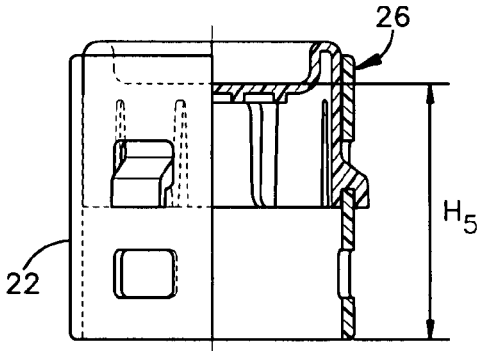
FIG. 10 is a side view, partially in section, of the bed riser of FIG. 1 in a third assembled position, disclosing a fifth elevation.
Figure 11:
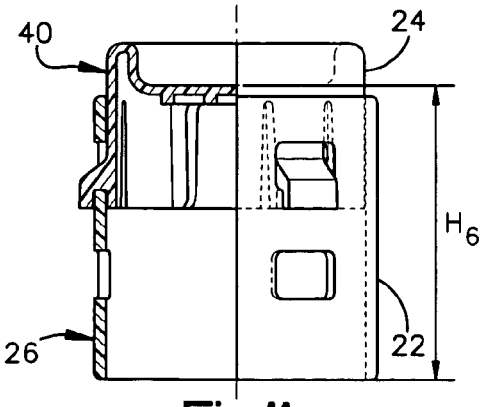
FIG. 11 is a side view, partially in section, of the bed riser of FIG. 1 in a fourth assembled position, disclosing a sixth elevation.
Figure 12:
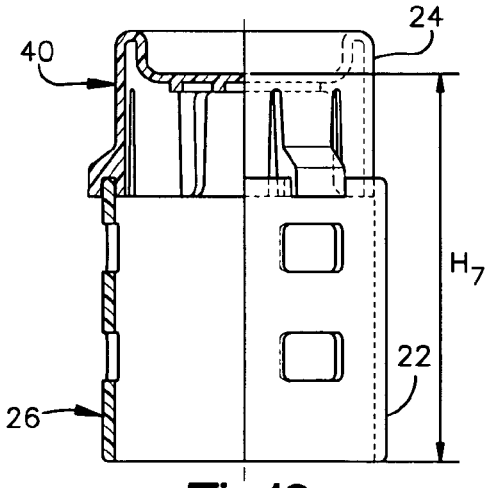
FIG. 12 is a side view, partially in section, of the bed riser of FIG. 1 in a fifth assembled position, disclosing a seventh elevation.

FIGS. 8–11 are side views, partially in section, of the bed riser 10 in a series of assembled positions. FIG. 8 shows a third elevation $H_3$, FIG. 9 shows a fourth elevation $H_4$, FIG. 10 shows a fifth elevation $H_5$ and FIG. 11 shows a sixth elevation $H_6$. In FIGS. 8–11, the forks 52*a*, 52*b*, 52*c* of the support piece 24 are inserted into one set of apertures of the base 22. The four height combination are achieved by the use of two variables. First, two different insertion directions are used by inverted the base 22 in relation to an upright position shown in FIG. 2. Second, the forks 52*a*, 52*b*, 52*c* are inserted into the first set of apertures 32*a*, 32*b*, 32*c* and alternatively, into the second set of apertures 34*a*, 34*b*, 34*c*. These two variables with two combinations each create the four heights.

FIG. 12 is a side view, partially in section, of the bed riser of FIG. 1 in a fifth assembled position, showing a seventh elevation $H_7$. As mentioned, in this position the support piece 24 is inserted upon the annular first edge surface 36 of the base 22.

The following chart details the elevations achieved by one embodiment of the present invention. In this embodiment, the base 22 is 4.45 inches in length. The bottom edge of the first set of apertures is 3.00 inches from the bottom of the base and the bottom edge of second set is 1.25 inches from the bottom. The top edge of the first set of apertures is 0.70 inches from the top of the base and the top edge of second set is 2.45 inches from the top. In regard to the support piece 24, the bottom surface 70 of the bottom cavity 48 is 1.00 inches from the top of the support piece and the bottom surface 72 of the top cavity 46 is 1.85 inches from the bottom of the support piece. The distance from the bottom surface 72 of the top cavity 46 to the top inner surface of the fork notch is 1.55 inches.

| FIG. | Bed Leg Elevation | Support Position | Base Position | Fork Mounting |
|---|---|---|---|---|
| 6 | $H_1$ - 1" | Inversed | N/A | N/A |
| 7 | $H_2$ - 1.85" | Upright | N/A | N/A |
| 8 | $H_3$ - 2.25" | Upright | Inversed | in first set |

-continued

| FIG. | Bed Leg Elevation | Support Position | Base Position | Fork Mounting |
|---|---|---|---|---|
| 9 | $H_4$ - 2.80" | Upright | Upright | in second set |
| 10 | $H_5$ - 4.00" | Upright | Inversed | in second set |
| 11 | $H_6$ - 4.55" | Upright | Upright | in first set |
| 12 | $H_7$ - 6.00" | Upright | Upright | on top edge |

It should be understood by others with ordinary skill in the art that the above-enumerated elevations are for exemplary purposes only, and by varying the location and number of the apertures, and the size of the support piece and riser, virtually any combination of elevations can be achieved.

While one embodiment of the invention has been illustrated and described in considerable detail, the present invention is not to be considered limited to the precise constructions disclosed. Various adaptations, modifications and uses of the invention may occur to those skilled in the arts to which the invention relates. It is the intention to cover all such adaptations, modifications and uses falling within the scope or spirit of the claims filed herewith.

What is claimed is:

1. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity;

c) a set of two or more forks protruding from said support piece side surface generally toward said bottom end portion; and d) wherein each fork of said set of forks is removably insertable into one aperture of said at least one set of apertures, such that said base and said support piece are coaxially aligned.

2. The bed riser assembly of claim 1 wherein said hollow base is tube shaped.

3. The bed riser assembly of claim 1 wherein said outer longitudinal surface is cylindrical shaped.

4. The bed riser assembly of claim 1 wherein said support piece is removably insertable into said base in either of a direction from said first end portion to said second end portion or in a direction from said second end portion toward said first end portion.

5. The bed riser assembly of claim 1 wherein each of said set of forks is removably insertable into one of said at least one set of apertures in either of two opposing directions.

6. The bed riser assembly of claim 1 wherein said top cavity is adequately sized to allow insertion of an end of a bed frame leg therein.

7. The bed riser assembly of claim 1 wherein said bottom cavity is adequately sized to allow insertion of an end of a bed frame leg therein.

8. The bed riser assembly of claim 1 wherein said base first end portion comprises a tapered annular rim, wherein said rim is removable insertable between each of said set of forks and said side support side surface.

9. The bed riser assembly of claim 1 wherein said support piece is insertable within said base through either said first end portion or said second end portion.

10. The bed riser assembly of claim 1 wherein said apparatus is adjustable to provide seven different elevations for a bed frame leg.

11. The bed riser assembly of claim 1 wherein said at least one set of apertures comprises at least two apertures, wherein each aperture of said at least two apertures is equidistant from said first edge surface.

12. The bed riser assembly of claim 1 wherein said at least one set of apertures comprises at least two apertures, wherein each of said at least two apertures is essentially identical is size and shape.

13. The bed riser assembly of claim 1 wherein said at least one set of apertures comprises three apertures, wherein each aperture is essentially identical is size and shape, and is equidistant from said first edge surface.

14. The bed riser assembly of claim 1 wherein said base balances upon a horizontal surface by either said first edge surface or by said second edge surface.

15. The bed riser assembly of claim 1 wherein each fork of said set of forks is equidistantly disposed about a circumference of said support piece side surface.

16. The bed riser assembly of claim 1 wherein each aperture of said at least one set of apertures is equidistantly disposed about a circumference of said base outer longitudinal surface.

17. A bed riser assembly for providing a plurality of selectable elevations for a bed frame leg, said apparatus comprising:

a) a tubular base having an outer cylindrical surface, a first end portion having a first annular edge surface, a second end portion having a second annular edge surface, a first set of apertures, and a second set of apertures, wherein each of said first set and said second set comprises three apertures extending through and equidistantly disposed about said outer cylindrical surface of said tubular base;

b) a support piece insertable within said base and having a side surface, a top end portion defining a top cavity, and a bottom end portion defining a bottom cavity; and c) a set of three forks protruding from said support piece side surface generally toward said bottom end portion, wherein each of said set of three forks is equidistantly disposed about a circumference of said support piece side surface;

d) wherein each of said set of forks is removably insertable into one of said first set of apertures in either a direction generally toward said first end portion or in a direction toward said second end portion, such that said base and said support piece are coaxially aligned.

18. The bed riser assembly of claim 17 wherein each of said set of forks is removably insertable into one of said second set of apertures in a direction generally toward said first end portion, such that said base and said support piece are coaxially aligned.

19. The bed riser assembly of claim 17 wherein each of said set of forks is removably insertable into one of said second set of apertures in a direction generally toward said second end portion, such that said base and said support piece are coaxially aligned.

20. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity;

c) a set of forks protruding from said support piece side surface generally toward said bottom end portion; and d) wherein each of said set of forks is removably insertable into one of said at least one set of apertures, such that said base and said support piece are coaxially aligned and further wherein said support piece is removably insertable into said base in either of a direction from said first end portion to said second end portion or in a direction from said second end portion toward said first end portion.

21. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity;

c) a set of forks protruding from said support piece side surface generally toward said bottom end portion; and d) wherein each of said set of forks is removably insertable into one of said at least one set of apertures, such that said base and said support piece are coaxially aligned and further wherein each of said set of forks is removably insertable into one of said at least one set of apertures in either of two opposing directions.

22. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity wherein said bottom cavity is adequately sized to allow insertion of an end of a bed frame leg therein;

c) a set of forks protruding from said support piece side surface generally toward said bottom end portion; and d) wherein each of said set of forks is removably insertable into one of said at least one set of apertures, such that said base and said support piece are coaxially aligned.

23. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity;

c) a set of forks protruding from said support piece side surface generally toward said bottom end portion; and d) wherein each of said set of forks is removably insertable into one of said at least one set of apertures, such that said base and said support piece are coaxially aligned and further wherein said support piece is insertable within said base through either said first end portion or said second end portion.

24. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity;

c) a set of forks protruding from said support piece side surface generally toward said bottom end portion; and d) wherein each of said set of forks is removably insertable into one of said at least one set of apertures, such that said base and said support piece are coaxially aligned and further wherein each of said at least one set of apertures comprises at least two apertures, wherein each of said at least two apertures is equidistant from said first edge surface.

25. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity;

c) a set of forks protruding from said support piece side surface generally toward said bottom end portion; and d) wherein each of said set of forks is removably insertable into one of said at least one set of apertures, such that said base and said support piece are coaxially aligned and further wherein said base balances upon a horizontal surface by either said first edge surface or by said second edge surface.

26. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity;

c) a set of forks protruding from said support piece side surface generally toward said bottom end portion; and d) wherein each of said set of forks is removably insertable into one of said at least one set of apertures, such that said base and said support piece are coaxially aligned and further wherein each of said set of forks is equidistantly disposed about a circumference of said support piece side surface.

27. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity;

c) a set of forks protruding from said support piece side surface generally toward said bottom end portion; and d) wherein each of said set of forks is removably insertable into one of said at least one set of apertures, such that said base and each of said at least one set of apertures is equidistantly disposed about a circumference of said base outer longitudinal surface.

28. A bed riser assembly for providing a plurality of selectable elevations for a bed frame leg, said apparatus comprising:

a) a hollow base having an outer longitudinal surface, a first end portion having a first edge surface, a second end portion having a second edge surface, and at least one set of apertures, wherein each aperture extends through said outer longitudinal surface;

b) a support piece insertable within said base and having a side surface, a top end portion defining a top cavity, and a bottom end portion defining a bottom cavity;

c) a set of forks protruding from said support piece side surface generally toward said bottom end portion, each of the set of forks adapted to flex inwardly when said support piece is inserted within said base; and d) wherein each of said set of forks is removably insertable into one of said at least one set of apertures, such that said base and said support piece are coaxially aligned.

* * * * *